US007971527B2

(12) United States Patent
Bausenwein et al.

(10) Patent No.: US 7,971,527 B2
(45) Date of Patent: Jul. 5, 2011

(54) MULTIPATH CD PRINTING SYSTEM

(75) Inventors: Alfred Bausenwein, Thüngersheim (DE); Rainer Endres, Karsbach (DE); Peter Schmitt, Würzburg (DE)

(73) Assignee: KBA-Metronic AG, Veitshochheim (DE)

( * ) Notice: Subject to any disclaimer, the term of this patent is extended or adjusted under 35 U.S.C. 154(b) by 837 days.

(21) Appl. No.: 11/998,158

(22) Filed: Nov. 28, 2007

(65) Prior Publication Data

US 2008/0138137 A1 Jun. 12, 2008

(30) Foreign Application Priority Data

Nov. 28, 2006 (DE) ..... 10 2006 056 475

(51) Int. Cl.
*B41F 17/00* (2006.01)

(52) U.S. Cl. ..... 101/35; 101/DIG. 30; 414/222.13; 414/285; 198/436; 198/448

(58) Field of Classification Search ..... 101/35, 101/DIG. 30
See application file for complete search history.

(56) References Cited

U.S. PATENT DOCUMENTS 2,656,911 A * 10/1953 Boyce et al. ..... 198/435
2,753,975 A * 7/1956 Day et al. ..... 198/448
2,857,037 A * 10/1958 Breeback ..... 198/436
3,463,296 A * 8/1969 Eisen ..... 198/447
3,583,545 A * 6/1971 Hovekamp ..... 414/795.6
3,667,916 A * 6/1972 Sliva et al. ..... 436/1
4,618,052 A * 10/1986 Rickett et al. ..... 198/370.13
6,082,256 A * 7/2000 Hellmeier et al. ..... 101/35
6,227,348 B1 * 5/2001 Frei et al. ..... 198/439
2002/0017206 A1 2/2002 Douville ..... 101/35
2003/0067499 A1 * 4/2003 Shimizu ..... 347/2

* cited by examiner

*Primary Examiner* — Jill E Culler
(74) *Attorney, Agent, or Firm* — Andrew Wilford

(57) ABSTRACT

Images are printed on surfaces of discrete objects that are loaded onto an upstream end of a production path passing through a plurality of treatment stations and taken off a downstream end the path. The path passes through a plurality of treatment stations and is split at least one of the stations into a plurality of generally parallel lanes each having a respective treatment device or printer. At the one treatment station the objects are split up and fed to the lanes from the path, the images are printed on the objects in the lanes with the respective printers, and all the objects are returned to the path after printing. The objects move single-file downstream along the path upstream and downstream of the one station. Instead of printers, each lane can have some other type of treatment machine and the operations performed by these treatment machines in the lanes can be the same or different.

17 Claims, 4 Drawing Sheets

MULTIPATH CD PRINTING SYSTEM

FIELD OF THE INVENTION

The present invention relates to a printing system. More particularly this invention concerns such a system for printing individual objects such as CD's or DVD's's.

BACKGROUND OF THE INVENTION

In the single-color or multi-color printing of individual objects, particularly with variable data and particularly comprising at least one flat surface to be imprinted, the individual objects are moved along a production path from at least one input station, through various treatment (e.g. whitening, printing, coating, drying) stations, and are taken off the production pat at a downstream output station.

The industrial printing of such individual objects as data carriers, for example CD's or DVD's or other products used in daily life, is done by means of screen printing, flexographic printing, pad printing, offset printing, flat-bed printing, rotogravure or letterpress printing to transfer one or more colors to an object surface to be printed. The imprint serves decorative, advertising and/or informational purposes, either for the end user or for product tracking by the manufacturer.

In addition, increasingly efforts are in progress to use the image printed on an object as an individualization instrument or for product protection purposes, for example in that variable data is imprinted in plain text or as machine-readable code. In this way, for example, an imprint on a data carrier, such as a CD or DVD's, may comprise a variable serial number or an access code in addition to an otherwise non-variable background. For this purpose, either separate identifying methods or additional digital printing methods, such as ink-jet printing, laser printing, transfer printing and the like, are used, so as to apply individualized printed data.

In order to achieve full individualization, which allows the complete layout, for example of a series of CD's to be printed, to be optionally varied within the production sequence, CD printing systems are equipped, for example, with computer-controlled printers that make it possible to provide the entire surface of the CD to be printed with a multi-color imprint.

Similar methods and printers are known from home and office applications, where office printers today are able to print CD's bearing elaborate printing. The print quality approaches that of offset print.

All these printing methods that are already in use share the fact that they print the objects in linear sequence, each object running sequentially through a certain number of treatment stations. The treatment stations may comprise handling devices, test and readers, substrate pre-treatment, printing stations, coating stations, drying stations and the like. Every object being printed goes through every station, although some stations may not act on some objects or may treat different objects differently.

The material flow of the objects through all treatment stations present in a certain printing system means each object at any given time is followed by another object or at least an object position, thus creating a linear processing chain in which each object successively passes through the consecutive treatment stations. A malfunction interrupting this chain at any point results in stoppage of the entire production run until the error has been eliminated and production can resume. The result is a considerable loss of actual production.

Experience has shown that ink-jet print heads are particularly susceptible to problems, triggered either by external influences, such as vibration, high acceleration, dust, electrostatic charge, mechanical impact and the like, or by internal influences, such as ink contamination, ink outgassing and the like, as a result of which individual or a plurality of nozzles or nozzle groups or even entire print heads can fail. Since the print heads used in these printing methods operate based on the drop-on-demand principle, each head has an array of individually controlled nozzles, so that the failure of one or more nozzles of a print head fail causes undesirable stripes in the printed image or dropping out individual colors partially or completely. Automatic or manual cleaning and restart of the affected print heads in general eliminates the defect, however for the duration of the cleaning process this print station of the entire printing system is down, production is stopped. This lowers the effective production output considerably, as mentioned above.

An increase in the effective production output in this configuration of the printing system may therefore only be achieved by considerably improving the reliability of the print heads and/or by considerably increasing the speed of the printing operation and all other treatment stations so as to compensate for the down time. Even simultaneous printing of multiple objects in a common printer offers effective improvement only part of the time. When the current print speed increases, in the event of an error not only one object will be printed incorrectly, but a certain quantity, considerably increasing the volume of waste. In addition, increased print speed of the digital printers is associated with the risk of more frequent failures because all components involved in the process are subject to greater use and stress.

OBJECTS OF THE INVENTION

It is therefore an object of the present invention to provide an improved cd printing system.

Another object is the provision of such an improved cd printing system that overcomes the above-given disadvantages, in particular that can print a succession of discrete objects with images, if necessary changing image on-the-fly, that is without stopping a production run.

Another object of the invention is to create a method that makes it possible to compensate for the individual limitations and disadvantages of digital printers and to create a printing system that allows a continuously high production output to be achieved in the printing of images on individual objects.

SUMMARY OF THE INVENTION

Images are printed on surfaces of discrete objects that are loaded onto an upstream end of a production path passing through a plurality of treatment stations and taken off a downstream end the path. The path passes through a plurality of treatment stations and is split at least one of the stations into a plurality of generally parallel lanes each having a respective treatment device or printer. At the one treatment station the objects are split up and fed to the lanes from the path, the images are printed on the objects in the lanes with the respective printers, and all the objects are returned to the path after printing. The objects move single-file downstream along the path upstream and downstream of the one station. Instead of printers, each lane can have some other type of treatment machine and the operations performed by these treatment machines in the lanes can be the same or different.

This way the weak link in the production process, the treatment machine that is most likely to fail, is made redundant so that the failure of one printer does not bring down the entire operation. For example if a printer runs out of ink or jams, the other parallel printers continue working while the problem is dealt with. This way some production capacity is lost, but when there are sufficient parallel printers, it might even be able to keep up a normal production rate.

In other words, the printing of objects may be divided into a plurality of parallel production lanes, each of the parallel production lanes running through one or more printers and thus, within the parallel production lanes, the same treatment type is performed, which in this case is the printing operation. It may be provided that the division is made not only with respect to the printing operation, but, for example, also with respect to the drying operation or other treatment types. However, since based on experience the printing operation in printers is the area most prone to malfunctions within the entire production path, it is preferred to divide the production path into multiple production lanes with respect to the printing operation using printers.

According to another feature of the invention, the production path divided into a plurality of parallel production lanes is reunited into single-file and thereafter, optionally after performing a treatment step, further splittings and combinations may occur once or several times.

Furthermore, according to the invention the parallel operating lanes as such operate substantially independently and are synchronized particularly only by the controller of the higher-level production system with the associated input and output stations. This has the advantage that, for example, a printer disposed in one of these lanes can be cleaned automatically or manually, without influencing the functionality of the remaining lanes or even stopping the higher-level production system.

According to an advantageous embodiment, it may furthermore be provided that the printers operating, for example, parallel on the different production lanes can be supplied with various print orders controlled by software, as a result of which it is possible to process a plurality of different print orders simultaneously in the production system with a single production line.

The different print orders may be associated with respective plurality of the objects that are fed to one of the parallel production lanes. This may be done, for example, based on an identification provided on the object and based on which it is possible to recognize to which of the parallel production lanes an object must be fed, particularly if within such a parallel production lane the print order remains the same or, for example after feeding an object to an optionally arbitrary, for example free, parallel production lane, a printer must be reprogrammed to process the correct print order associated with the identification.

Furthermore, according to the invention it may advantageously be provided that the parallel operating printers, for example in the different lanes, by means of software control operate at different print resolutions and/or color profiles, so as to optimally print different print orders, for example. Also the software control may be performed based on identifications as mentioned above.

According to the invention the parallel operating printers, for example in the different lanes, by means of software control operate at the same print resolutions and/or color profiles and produce identical print qualities by means of a separately performed calibration of the printers, making it possible to send the same print orders through a plurality of and/or arbitrary lanes without resulting in noticeable differences in the print.

Furthermore, it may advantageously be provided according to the invention that, for example, one or more of the parallel operating printers in the different lanes operate with different printing colors, for example special colors or safety colors, and that by means of software control print orders can be assigned to this printer, eliminating a complex and time-consuming replacement of printing colors.

Furthermore, according to the invention the printing system comprises different additional treatment stations that may be upstream or downstream of the above-mentioned printers, and that make it possible to apply, for example, a primer or background to better receive the color or a protective coating to the objects.

According to the invention, it may also be advantageously be provided that the above-mentioned different additional treatment stations, which based on experience are highly reliable and have a reliable operation, are provided in the printing system only individually and that all objects to be treated and/or printed run through them. Upstream of such treatment stations, the production path that previously was divided into a plurality of lanes is brought back together and then optionally divided again after one of these treatment stations.

In accordance with the invention based on an printed or embossed identification each object to be printed is captured by software and tracked within the production lane or the entire path such that it is possible to transport the object to an associated storage position after printing has occurred. In this way, it is ensured that the different print jobs located simultaneously on the printing system are not mixed up. Likewise, by means of an identification on or in the object—as mentioned above by way of example—it is possible to determine to which of a plurality of parallel production lanes an object is fed. In this way, the distribution is such that on the selected parallel production lane a treatment is performed that is associated with the identification of the object.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
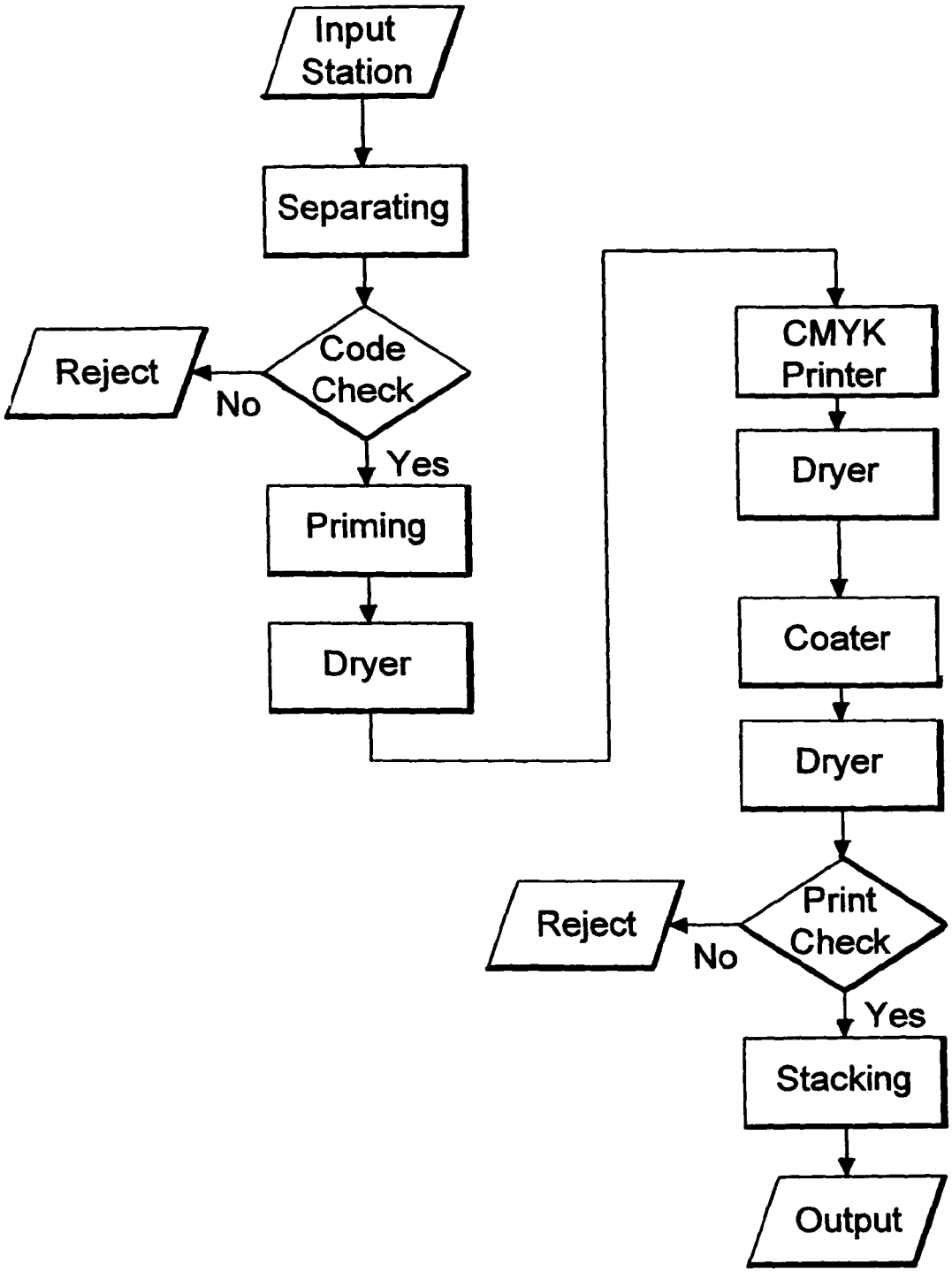
Fig. 1 Prior Art
FIG. 1 is a flow chart of a prior-art printing system.

FIG. 1 shows, by way of example, the logic sequence of operations of a conventional printing system, for example for printing CD'S. The production path starts at an input station, at which the CD spindles filled with blank CD's are placed in the machine. Since in general a plurality of filled CD spindles are present simultaneously in the input, for example to guarantee a continuous material flow by means of an automatic spindle changing device, the CD spindles are fed consecutively to a separating station, at which the CD's threaded onto an arbor located on each spindle are taken off the spindle and placed on a first conveyor or a first processing station.

This can be, for example as shown in FIG. 1, a code-check reader that is used to verify, based on the plain text code or machine-readable code printed or embossed in each CD, whether this CD matches the image to be printed in the subsequent printer. This reference information, which is to say which printed design is associated with which CD code, is expediently previously stored in a higher-level controller before starting the respective print job. If the verification is not successful, the CD is taken out of the normal production sequence and placed, for example, on a specially provided reject spindle.

However, once the verification has been performed, the CD is transferred to the next processing station by means of a conveyor system, for example to a whiting station in which a white background is printed on the surface of the CD to be imprinted, so as to create a uniform background for the subsequent multi-color printing operation. After printing and subsequent drying of the white ink, the CD is moved downstream to a subsequent treatment station, for example a CMYK printer that is used to print the respective cyan, magenta, yellow and black colors of a printed design onto the previously applied white background.

Following drying, for example in a subsequent processing station, a protective clear paint can be applied to the previously printed design and then dried. In a subsequent print check system, the actual print quality is compared to a reference image stored previously in the memory of a higher-level controller, and the printed CD is either sorted out if it does not pass this test and placed, for example, in another reject spindle that is provided, or it is stacked onto subsequent empty spindles and forwarded to the output station if it passed the verification, where the spindles filled with printed CD's can be removed by an operator. It is easy to see that in this type of production flow always only a single print job can be processed so as to prevent mixups of different print jobs on the spindles. It is also easy to see that an interruption of the production sequence described by way of example at any given location of the production chain results in stopping of the entire production machine because only a single production path exists.

Figure 2:
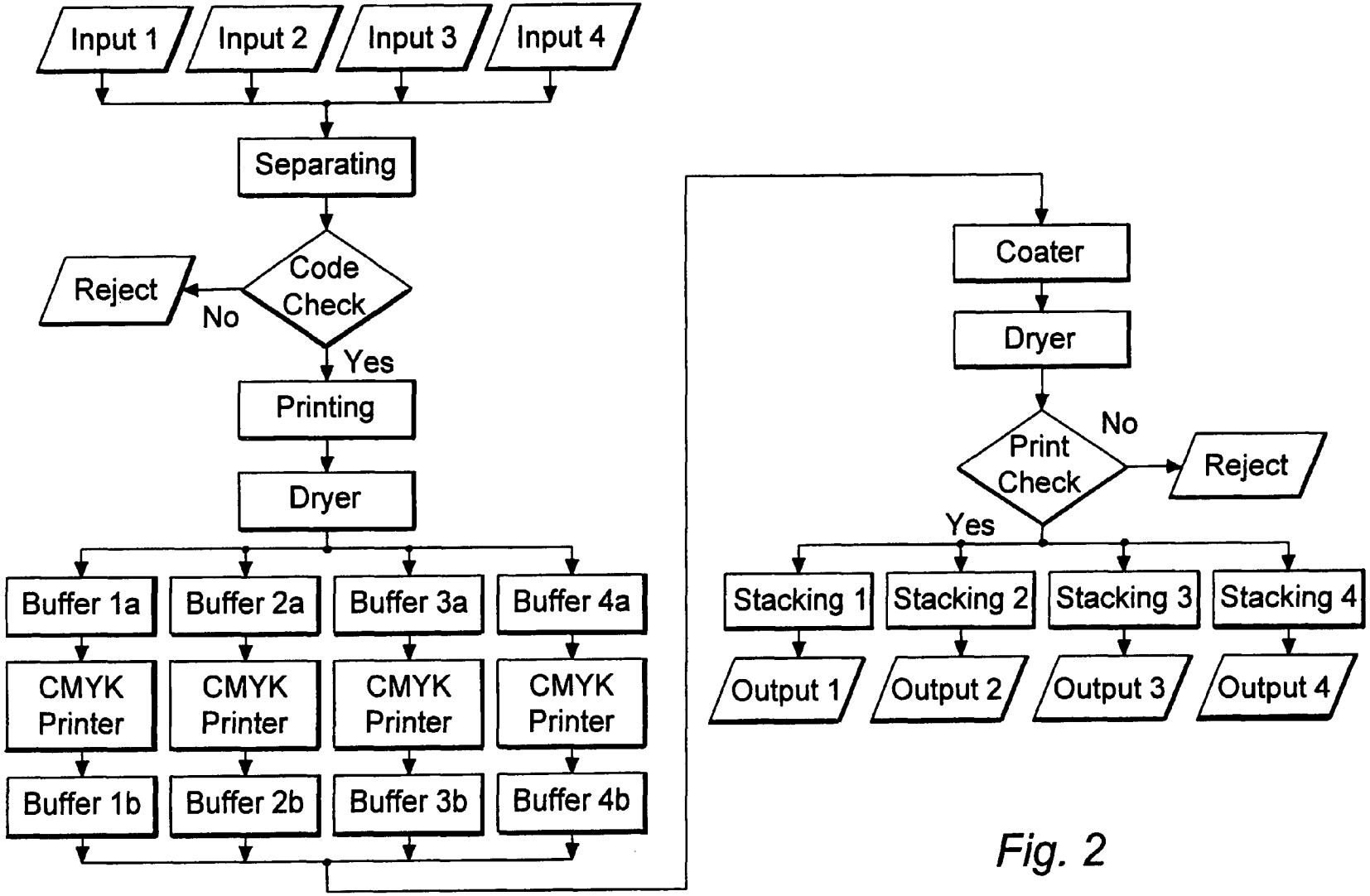
FIG. 2 is a flow chart of the printing system according to the invention.

FIG. 2 in contrast shows the production sequence and the product flow of an embodiment according to the invention. The example, including that of the following figures, is described based on CD's as objects. Without limiting scope, the example however applies in an equivalent fashion to any arbitrary other objects.

From the plurality of CD spindles located in a plurality of input stations and filled with blank CD's, alternately or in any arbitrary sequence, CD's are removed by means of a common separating system and transported to a first treatment station. Since on each of the CD spindles as a result of the preceding production of the CD's only CD's of a certain kind are provided, these CD's each being associated with a certain print job, a plurality of CD spindles filled with different CD'S may be located in the input stations. Depending on the type of production flow that is desired, the removal of the CD's from the different removal stations may be done cyclically or electively, so that initially CD's of different types appear to be mixed along the subsequent treatment stations. Since the removal of CD's from the different removal stations is performed by means of a common separating system, the position of the removal spindle and the storage position of the respective CD on a subsequent conveyor systems or treatment station can be clearly defined and then stored and processed in a higher-level controller, for example by means of a shift register that is able to determine at any time the current position of each CD in the entire production line.

A first treatment station downstream of the removal station can be, for example, the code-check reader shown according to FIG. 2, which verifies whether the read CD is part of one of the current print jobs stored in a higher-level controller. If this is not the case, this CD is culled out in the usual manner, and the above-mentioned CD position stored in the higher-ranking controller is marked as an empty position. At the same time, removal of CD's from the spindle, from which this CD was removed, can be stopped, specifically until new information is stored in the controller about further print jobs to be processed, or the spindle has been replaced by the operator.

Furthermore, it may expediently be provided that the code previously read from this sorted CD is stored in the memory for a certain duration and that this code is compared to the new print job information, so that in the event of a match this print job can likewise be started. For this purpose, removal from the spindle still blocked at this time can be released again and the CD's from this spindle can be incorporated into the production flow.

If the CD code that has been read corresponds to one of the stored print jobs, the CD is forwarded by means of a conveyor system to a next downstream treatment station, for example a whiting station, at which as described above a white background is printed on the CD surface to be imprinted so as to create a uniform background for the subsequent multi-color printing operation. Then each CD is dried.

By means of a downstream distribution systems, the white CD's are distributed among one of the subsequent production lanes, in which the CD's are imprinted with the appropriate images by a multi-color printer. So as to ensure that each CD is imprinted exclusively with the intended motif, the code information previously recorded in the reader and the associated detected position of the CD in the CD sequence is transmitted to the respective production lane and therefore-to the respective multi-color printer.

Since each of these printers operates independently from the remaining printing system as an independently operating freely programmable printer with a dedicated working memory as long as a CD to be imprinted is located in the respective printer's work area, the required printed design can be transmitted from the memory of a higher-level controller to the respective printer at a suitable time, without affecting the other printers or production units.

In addition, it is possible to perform cyclical or non-cyclical maintenance work, such as the periodic cleaning of the print heads, adjustments and the like, as an independently executed program inside each of the multi-color printers, without impairing operation of the rest of the production line. To this end, the printer reports, for example, a BUSY signal to the higher-level controller, as a result of which this production lane and this printer are blocked at least temporarily for the distribution system. After completing the printing operation and any potential maintenance work, the BUSY signal is reset and the printer's state is reported as READY to the higher-level controller, so that for example a CD just printed in this printer is removed by a distribution system from this production lane and optionally in the same cycle is replaced by a subsequent CD to be imprinted. At the same time, the print data intended for the new CD is transmitted to the printer.

In a subsequent step, a CD printed with multiple colors in this way is fed to a common coating station, in which the CD can be given a final protective coating. Since these types of treatment stations based on experience have a high production reliability, there is only one such coating unit and all CD's printed in the preceding printers run through these treatment stations, so that here again the different print jobs can be mixed.

After the coating step and an optionally required subsequent heat fixing or curing of the coating, the CD's are transported by a handling system to a downstream test device in which the printed images are compared to the reference images stored in the memory of the test device. It may be expedient to review in this test device also the respective CD code again in order to guarantee with 100% certainty that the printed design belongs to the read CD code.

After the review has been performed, the CD's that did not pass the verification are placed in a provided ejector station, for example on a reject spindle. The successfully verified CD's are distributed by means of a downstream distribution device to one of the output stations with the associated output spindles such that each output spindle of an output station only receives CD's of one job. For this purpose, the information read in the test device, for example the CD code, is transmitted to the controller of the distribution device, and the CD's are forwarded to the associated output station.

Figure 3:
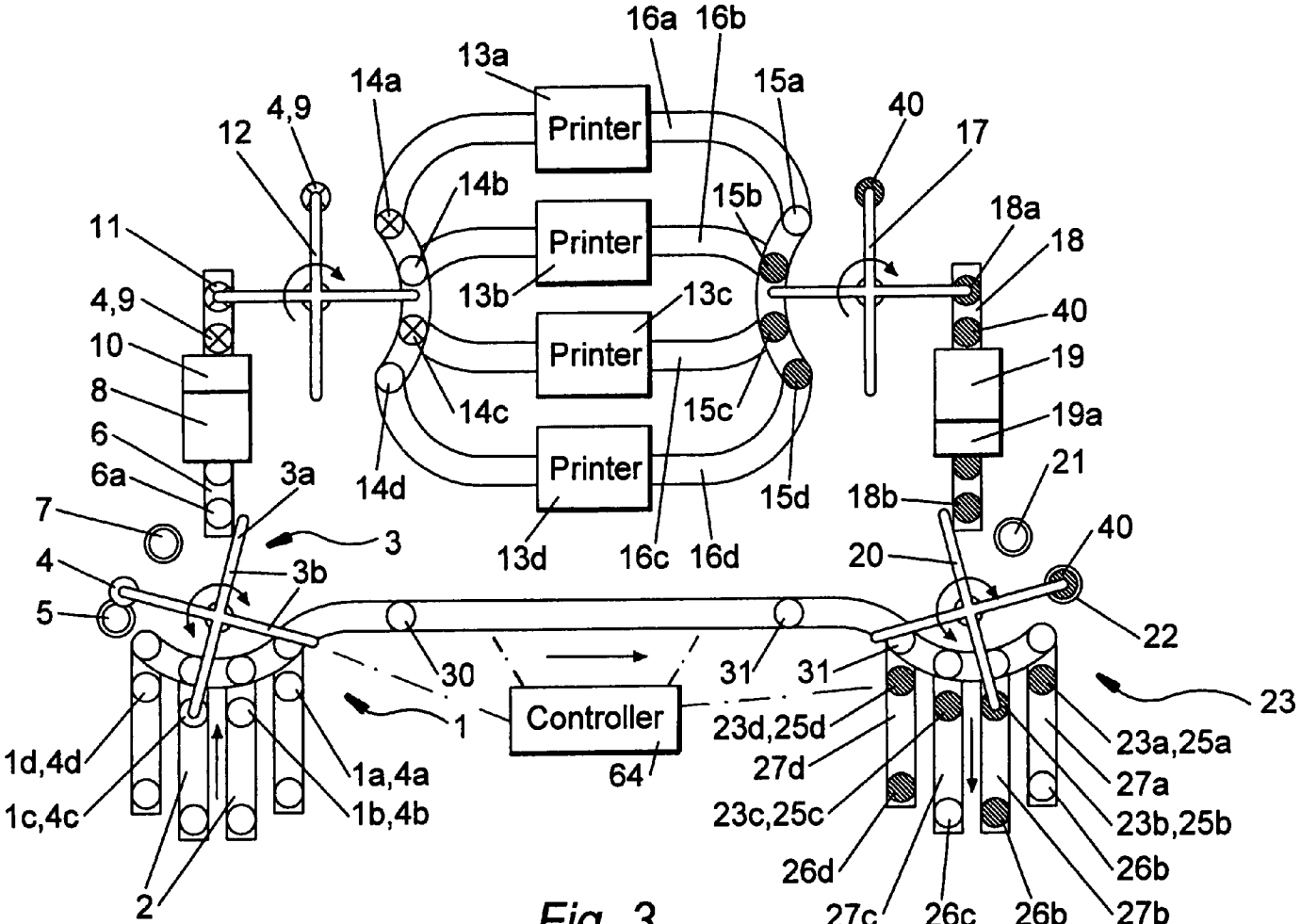
FIG. 3 is a partially schematic illustration of the printing system according to the invention with four printing paths.

FIG. 3 shows a schematic illustration of a first possible inventive embodiment of a printing system operating based on this principle. The entire production path extends in this case from an input unit or input station 1 to the coating station 8, then through four parallel production lanes in which respective printers 13*a-f* are disposed, to the drying device to the output station or output unit 23.

An input unit 1 comprises a plurality of input stations 1*a* to 1*d* where spindles 4*a* to 4*d* filled with unprinted CD's 4 are provided. These spindles 4*a* to 4*d* have previously been placed as needed on conveyors 2, for example by an operator, as a result of which the spindles are transported to the respective input stations 1*a* to 1*d*.

A removal system 3 that comprises, for example, a carousel 3*a* with a plurality of arms 3*b*, removes from one of the input stations 1*a* to 1*d* an unprinted CD 4 and transports it to a first treatment station 5, for example a CD code reader. For removal of the CD's, an unillustrated grab is provided on the end of each arm 3*b*, the grab removing an individual unprinted CD 4 from one of the spindles 4*a* to 4*d*. Depending on the configuration, an unillustrated lifting device may also be provided for each grab so as to compensate for the differences in height occurring in the course of CD removal during the removal of CD's 4 from one of the spindles 4*a* to 4*d*.

It may furthermore be expedient to detect the stack heights at the spindles 4*a* to 4*d* by means of sensors and adjust the lifting motion accordingly by means of a higher-level controller 64.

The sequence of CD removal from the different CD spindles 4*a* to 4*d* may be performed cyclically or electively, depending on the processing type selected for the specific print job.

The unprinted CD 4 transported to the first treatment station 5, which here is referred to as a CD code reader by way of example, is examined based on the identification printed or embossed in each CD to determine whether it is associated with one of the currently printed images that are stored in a higher-level controller 64. The CD codes and the associated printed designs are transmitted, for example by an operator, to the higher-level controller 64 as needed or this information is queried online by the controller 64, for example via a computer network, or transmitted to the controller 64. If concordance is determined, the unprinted CD 4 examined in this way is transported, for example, by means of the removal system 3 to an intake side 6*a* of a downstream conveyor 6. If no concordance is determined, this unprinted CD 4 is transported by means of the removal unit 3 to a cull station 7, for example a specially provided reject spindle.

The unprinted CD 4 deposited in the intake 6*a* is transported in a subsequent step by means of the conveyor 6 to a subsequent coating station 8, for example a first printer, in which it may be provided with a base coat 9. The coater 8 may be a flexographic printing station, screen-printing station, rotogravure station, letterpress printing station or coating station or the like. It may also be a freely programmable printer, for example an ink-jet printer.

The properties of the base coat 9 or a corresponding printing ink are selected such that the printing taking place in one of the subsequent printers 13*a* to 13*d* can be performed without difficulty and additionally optimal printing results are achieved. In addition, the base coat 9 or the printing ink may be white or colored, or even transparent, depending on requirements. The base coat 9 applied here is a white printing ink, a microporous coating, an ink-absorbing coating or the like, or a combination of such coatings. It is also possible that this base coat 9 applied in the coating station 8 is applied as layers by means of a plurality of printers provided in the coating station 8, so as to create an optimized subsurface for the subsequent printing step using the freely programmable printers 13*a* to 13*d*.

A drying device 10 downstream of the coating station 8 along the conveyor 6 cures the base coat 9 applied in this way, depending on the type of base coat or printing ink used, for example by means of hot air, heat treatment or radiation.

In a next step, the unprinted CD 4 coated in this way is transported to a subsequent output station 11 from which the CD 4 is removed by means of a manipulator 12 and transported to one of the subsequent printers 13*a* to 13*d*. Depending on the present state of the printers 13*a* to 13*d* operating parallel in this section of the production sequence, the Coated but unprinted CD 4 taken off the position 11 by the manipulator 12 is deposited on an intake position 14*a* to 14*d* of one of the printers 13*a* to 13*d* available at that time. A printer is not available when it is down (e.g. is jammed or out of ink, has clogged jets), its intake is full, or it for some reason it cannot accept another object.

For this purpose, the present states of all printers 13*a* to 13*d* and the associated CD input positions 14*a* to 14*d* as well as the associated CD takeoff positions 15*a* to 15*d* are reported by means of suitable unillustrated sensors to the higher-level controller 64. In this way, the higher-level controller 64 knows, for example, which printer 13*a* to 13*d* is printing at any given time or is ready for a new print job, or in which unit automatic maintenance, for example cleaning of the print head and the like, is taking place, and on which input position 14*a* to 14*d* and on which removal position 15*a* to 15*d* a blank or printed CD is located or which of these positions is free.

Based on this information, the higher-level controller 64 decides to which printer 13*a* to 13*d* the coated but unprinted CD 4 that was taken off the position 11 by means of the manipulator 12, for example again a carousel, is forwarded in that this CD 4 is deposited on the associated free input position 14*a*, 14*b*, 14*c*, or 14*d*. The associated printer 13*a* to 13*d* may still finish processing a preceding print job at this time.

After completing this print job, a printed CD 40 is transported by means of a conveyor 16*a* to 16*d* integrated in the printer to the respective removal position 15*a* to 15*d*, and subsequently the blank CD 4 is transported from the respective storage or intake position 14*a* to 14*d* into the associated printer 13*a* to 13*d*.

At this time, or even before that, the printed design associated with this CD 4 is loaded into the working memory of the associated printer 13*a* to 13*d* and the printing operation is started. Since starting with the read position 5 the determined CD information is "forwarded" synchronously with every movement of the CD along the conveyor path in the working memory of the higher-level controller 64, for example by means of a shift register, it is possible to transmit the corresponding design to be printed, along with the position of the respective CD 4, to the respective printer 13*a* to 13*d*. In principle, it is irrelevant in this case to which of the different printers 13*a* to 13*d* a certain CD 4 is forwarded.

After printing the respective CD in the associated printer 13*a* to 13*d*, the imprinted CD 40 is transported by means of the respective conveyor 16*a* to 16*d* to the respective removal position 15*a* to 15*d* whence it is removed by means of a manipulator 17, for example again a carousel, and transferred to a subsequent conveyor 18, for example a conveyor belt. By means of a subsequent treatment station 19, for example another coating station, along the conveyor 18, in a subsequent process step, for example, a clear coating can be applied to the printed surface of the CD 40 in order to achieve, for example, mechanical protection of the printed design and/or a glossy surface.

A downstream drying device 19*a* cures the applied coating, for example by means of heat or UV radiation. The subsequent manipulator 20 removes the coated CD from the removal position 18*b* and feeds it in a subsequent step to a print check device 21 in which the printed design is compared to the associated reference design stored in the memory of the higher-level controller 64. Depending on the number of print jobs then in progress in the printing system, one or more reference designs may be stored in the controller 64, so that it is necessary in a first verification step to determine the type of printed image based on previously defined and unique criteria and then, in a subsequent step, perform the evaluation of the print results.

Since such a procedure typically requires more time, the system preferably has a print check system in additional to the code-check system in order to determine, within the shortest possible time, whether the printed CD 40 bears the image it is supposed to have, by actually scanning the image printed on the CD 40, comparing the scanned image with the images in the memory of the controller 64, and, when there is a match, determining if the right image was applied to the CD 40. This ensures proper assignment of the CD to the printed design at all times. If the print results and/or the CD and its printed design do not match the stored criteria, the printed CD 40 is culled out by the manipulator 20, for example a carousel, and is deposited, for example, on a dedicated reject or cull spindle 22.

If the examination of the image printed on the CD 40, however, produces a match, the printed CD 40 is moved downstream to an output spindle 23*a* to 23*d* in the output station 23, with each spindle 23*a* to 23*d* receiving a stack of identically printed CD's 40. When the controller 64 determines that a given print job is complete and that the last of the CD's 40 for that print job has been stacked on one of the output spindles 23*a* to 23*d*, it shifts it via a respective conveyor 27*a*, 27*b*, 27*c*, or 27*d* down from the loading station 25*a*, 25*b*, 25*c*, or 25*d* to a respective unloading or output station 26*a*, 26*b*, 26*c*, or 26*d*. From here an operator or another automatic machine can safely take away the stacks of sorted like-printed CD's 40 while the printing system continues to print and stack new jobs in the stations 25*a*, 25*b*, 25*c*, and 25*d*. To this end, an empty spindle 31 is transported automatically to any vacant position 25*a* to 25*d*, so that the respective position 25*a* to 25*d* has a spindle available for filling.

At this time, the higher-level controller 64 assigns one or more of these positions 25*a* to 25*d* to a new, subsequent print job, so that the printed and verified CD's 40 of this subsequent print job are transported exclusively to this position or these positions. In this way, it is guaranteed that exclusively CD's of a certain print job are located on a spindle and different print jobs are not mixed with each other.

The provision of the above-mentioned empty spindles 31 in the output region 23 may be effected, for example, in that the spindles emptied in the input region 1 are automatically taken off the respective removal position 1*a* to 1*d* and are transported by means of a conveyor belt 30 to the output region 23 where they are available for assignment to one of the storage positions 25*a* to 25*d*.

The essential advantage according to the invention apparent in this configuration is that the production path for the critical but sensitive step of actually printing the CD's in this embodiment is divided into four parallel production lanes on each of which the necessary equipment for printing is provided.

Figure 4:
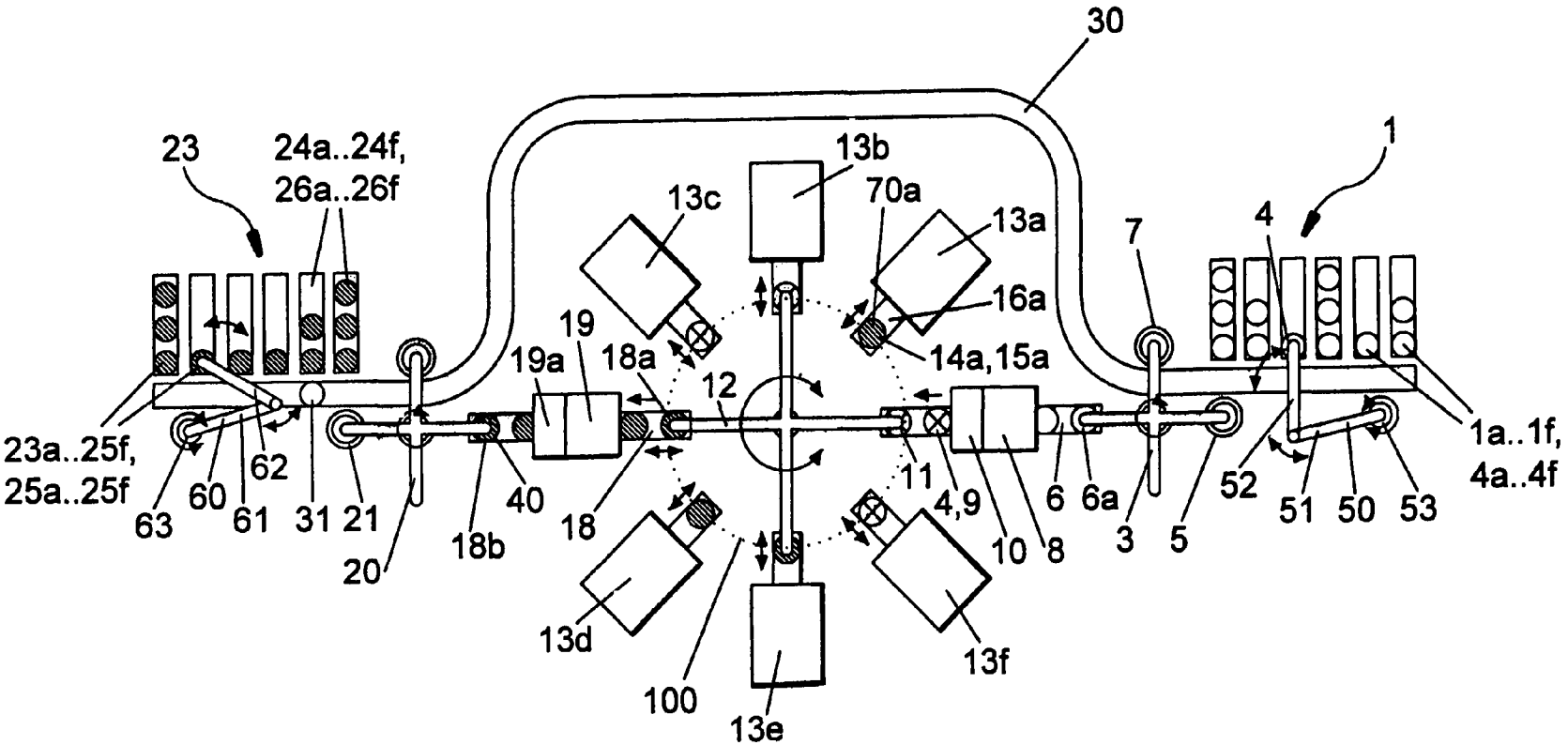
FIG. 4 is a system like FIG. 3 but with six printing paths.

An alternative embodiment according to the invention comprising six color printing stations is illustrated schematically in FIG. 4. In this example, the production path extends from right to left. In the input unit 1, a plurality of input stations 1*a* to 1*f* are provided. The number of input stations preferably and advantageously corresponds to the number of CMYK printers 13*a* to 13*f* used. This advantageously makes it possible to process an equal number of print jobs parallel to each other during a production run. It is also possible, however, to use a number of input stations that varies from the number of printers.

The CD's 4 to be imprinted are taken off the spindles 4*a* to 4*f* filled with blank CD's by means of a first manipulator 50 that may be configured, for example, as a robot arm with arm parts 51 and 52 displaceable relative to one another and displaceable by means of an unillustrated drive about an axis of rotation 53. For this purpose, in identical or similar fashion at the end of the arm segment 52 an unillustrated grab is provided that can be used to remove CD's 4 individually from the spindles 4*a* to 4*f*.

Each CD 4 removed in this way is subsequently placed in an input device of a code reader 5, where it is identified based on printed or embossed identification. The removal of the CD's from the spindles 4*a* to 4*f* in the first embodiment may be performed cyclically or in variable sequence and is defined as needed by a higher-level process controller 64.

Depending on the result of the identification step, in a next step the CD 4 identified in the reader 5 is either, as described above, transported to a reject spindle 7 or deposited in a storage position 6*a* of a downstream conveyor 6. For example, this may be done by a manipulator 3 such as a carousel. From there, as described above, the CD is transported to a first printing device 8 in which it is provided with a corresponding base or prime coat. A subsequent dryer 10 fixes the base coat 9 in place so that the CD 4 thereafter can be further processed without difficulty.

By means of a subsequent manipulator 12, such as a carousel, the CD's 4 carrying the base coat are distributed to one of the subsequent multi-color printers in that they are placed on one of the intake devices 14*a* to 14*f* of a printing device 13*a* to 13*f*.

As described above, this may be done as a function of the present state of the respective printers, which is to say as a function of whether a printer is already busy printing a CD at the time in question, or whether a cleaning or maintenance cycle is being performed, or whether it is available to load a CD 4 to be printed. For handling the CD's 4, it may be expedient to put the printers 13*a* to 13*f* and particularly the intake devices 14*a* to 14*f* thereof and the storage positions 11 and 18*a* on a circular path, so that the manipulator 12 can access all positions without difficulty, particularly when the manipulator is configured as a carousel. Despite the visually circular arrangement of the printers about a common center that corresponds to the center of rotation of the carousel 12, all printers or some of them, or the production lanes extending through them, can be disposed parallel to one another for production purposes.

It may also be provided that one or more of the printers are disposed in series for production purposes, forming one or more printers that are disposed parallel for production purposes.

According to this illustrated embodiment, it may also be provided that the removal positions 15*a* to 15*f* are identical to the storage positions 14*a* to 14*f*, which is to say that the production path does not extend unidirectionally through the printers, but on the same path bidirectionally out of them again as well.

Multi-color printing of a CD 4 is then performed in that after depositing the CD 4 on the position 14*a* to 14*f*, the CD 4 is transported by means of a conveyor 16*a* to 16*f* into the printer 13*a* to 13*f* and is printed there. Due to the fact that the movements of the conveyor 16*a* to 16*f* are under the control of the respective controllers of the printers 13*a* to 13*f*, positioning of the CD in the printer, particularly in relation to the print heads, is performed such that optimal printing results are achieved. After completing the printing operation, the CD 4 is transported by means of the conveyor 16*a* to 16*f* to the output position 15*a* to 15*f*, whence it can be removed by means of the manipulator 12.

It may furthermore be provided that on the storage positions 14*a* to 14*f* intake devices 70*a* to 70*f* for the CD's are provided, in which the CD's can be fixed in an unambiguous position. The transport of the CD 4 into the printers 13*a* to 13*f* in this case occurs in that the intake devices 70*a* to 70*f* are transported with the CD 4 fixed thereon by means of the conveyors 16*a* to 16*f*.

Due to this type of embodiment, it is possible according to the invention—after the CD 4 has been imprinted in a first printer 13*a*—not to transport the CD printed in this way by means of the manipulator 12 initially to the output position 18*a*, but to deposit it in a input position 14*b* to 14*f* of a different printer 13*b* to 13*f* so as to achieve additional printing of the CD 4. If the CD 4, for example, is forwarded to the printer 13*f* and this printer is provided with special colors, such as gold, silver, fluorescent colors or the like, additional effects may be generated in the printed design or printed designs using more than the usual CMYK colors.

It is also possible with this embodiment to equip, for example, one of the printers with special colors at all times, so that depending on the requirements these colors can be added when printing a certain print job without having to perform the complex and time-consuming conversion of the printing system. The use of the above-mentioned intake holders 70*a* to 70*f* that provide accurate positioning, and the arraying of the printers 13*a* to 13*f* in a circle furthermore maintain register accuracy of the colors distributed among two or more printers, resulting in high print quality.

Upon completion of the printing step in one or more of the printers 13*a* to 13*f*, the printed CD is deposited by means of the manipulator 12 on the storage position 18*a* of the conveyor 16 and transported by means of this device to a subsequent treatment station, for example a coating station 19 with downstream dryer 19*a*, in which for example a protective coating can be applied to the printed CD 4. The printed CD 40 finished in this way is subsequently removed by means of a manipulator 20, for example a carousel, from the output position 18*b* and fed to a test system 21 where the print quality is assessed.

As described in the first embodiment, it may be advantageous to detect at the same time the CD code again by means of a further test device, so as to simplify the association of the printed design with the respectively stored reference design and also to guarantee correct assignment of the CD to the desired print design. If the CD does not pass this examination, the printed CD 40 is removed by means of the manipulator 20 from the test device 21 and subsequently deposited on a reject spindle 22. If the CD passes the test, the printed CD 40 is removed by the subsequent manipulator 60 from the test device and assigned to one or more defined storage positions 25*a* to 25*f* in accordance with the print job and deposited on the corresponding output spindle 23*a* to 23*f*. The manipulator 60 may be, for example, a robot arm with individual arm segments 61 and 62, the arm being rotatable about an axis of rotation 63, wherein at the end of the arm segment an unillustrated grab for the CD's is provided. The manipulators 50 and 60 may be configured identically.

The filled spindles 24*a* to 24*f* are then transported via conveyors 27*a* to 27*f* to the output positions 26*a* to 26*f*, from where the operator can remove them without risk and without difficulty.

The provision of the empty spindles 31 in the output region 23 may occur, as described in the first embodiment, for example in that the spindles emptied in the input region 1 are removed automatically from their respective output position 1*a* to 1*f* and are transported by means of a conveyor 30, such as a conveyor belt, to the output region 23, where they are available for assignment to one of the storage positions 25*a* to 25*d* and are transported, as needed, by means of unillustrated devices to the respective storage positions 25*a* to 25*f*. The conveyor 30 may extend around the printers 13*a* to 13*f* disposed in a circular shape.

With respect to all embodiments, it shall be noted that the technical characteristics mentioned in connection with any embodiment can be used not only with the specific embodiment, but also in the respectively other embodiments. All technical characteristics disclosed in this description of the invention shall be considered essential for the invention and can be combined arbitrarily with each other or can be used alone. The characteristics mentioned for CD's as an illustrated embodiment can likewise, or at least in similar fashion, be used for any arbitrary objects.

We claim:

1. A method of printing images on surfaces of discrete objects, the method comprising the steps of:

loading objects onto an upstream end of a production path passing through a plurality of stations and taking the objects off a downstream end of the path;

providing a plurality of generally parallel lanes at one of the stations and a respective printer in each of the lanes;

at the one station monitoring availability of the printers;

splitting the objects up and feeding the objects to the lanes from the path in accordance with the availability of the respective printers, printing the images on the objects in the lanes with the respective printers, and returning all the objects to the path after printing; and moving the objects single-file downstream along the path immediately upstream and downstream of the one station.

2. The printing method defined in claim 1, further comprising the steps of:

providing a plurality of generally parallel second lanes at a second one of the stations and a respective treatment machine in each of the second lanes;

at the second station splitting the objects up and feeding the objects to the second lanes from the path, treating the objects in the second lanes with the respective treatment machines, and returning all the objects to the path after treatment by the machines; and moving the objects single-file downstream along the path immediately upstream and downstream of the second station.

3. The printing method defined in claim 1 further comprising the step of:

storing the objects at a plurality of locations at the upstream end.

4. The printing method defined in claim 1, further comprising the step of:

passing the objects single-file through a station between the one station and the upstream end of the path.

5. The printing method defined in claim 1 wherein the objects are primed in one of the stations between the one station and the upstream end.

6. The printing method defined in claim 1, further comprising the step of:

passing the objects single-file through a station between the one station and the downstream end of the path.

7. The printing method defined in claim 6 wherein the objects are coated in the station between the one station and the downstream end.

8. A method of printing different images on surfaces of discrete objects, the method comprising the steps of:

loading objects onto an upstream end of a production path passing through a plurality of stations and taking the objects off a downstream end of the path;

providing a plurality of generally parallel lanes at one of the stations and a respective printer in each of the lanes;

at the one station splitting the objects up and feeding the objects to the lanes from the path, printing the different images on the objects in the lanes with the respective printers, and returning all the objects to the path after printing; and moving the objects single-file downstream along the path immediately upstream and downstream of the one station;

assigning the different images to the different objects;

monitoring position along the production path of each of the objects; and determining when an object is in a given printer and then operating that printer to print the respective image on the object.

9. A system for printing images on surfaces of discrete objects, the system comprising:

a conveyor defining a production path having an upstream end and a downstream end and passing through a plurality of stations including one station at which the path is split into a plurality of generally parallel lanes;

loading means for putting objects onto the path at the upstream end;

unloading means for taking the objects off the path at the downstream end;

means for moving the objects single-file along the path upstream and downstream of the one station; and a respective printer in each of the lanes;

control means for monitoring availability of the printers, splitting the objects up and feeding the objects to the lanes from the path in accordance with the availability of the respective printers, operating the printers to print the images on the objects in the lanes, and returning all the objects to the path after printing.

10. The printing system defined in claim 9 wherein the production path is split into a plurality of generally parallel second lanes at a second one of the stations, the apparatus further comprising:

respective treatment machines in the second lanes;

the control means further serving for, at the second station splitting the objects up and feeding the objects to the second lanes from the path, treating the objects in the second lanes with the respective treatment machines, and returning all the objects to the path after treatment by the machines, the conveyor moving the objects single-file downstream along the path immediately upstream and downstream of the second station.

11. The printing method system defined in claim 9, further comprising intake means for storing the objects at a plurality of locations at the upstream end.

12. The printing system defined in claim 9 wherein the conveyor passes the objects single-file through a station between the one station and the upstream end of the path.

13. The printing system defined in claim 12, further comprising means for priming the objects in the station between the one station and the upstream end.

14. The printing system defined in claim 9 wherein the conveyor means passes the objects single-file through a station between the one station and the downstream end of the path.

15. The printing system defined in claim 14, further comprising means for coating the objects in the station between the one station and the downstream end.

16. The printing system defined in claim 9 wherein the printers are ink-jet printers.

17. A system for printing different images on surfaces of discrete and different objects, the system comprising:

a conveyor defining a production path having an upstream end and a downstream end and passing through a plurality of stations including one station at which the path is split into a plurality of generally parallel lanes;

loading means for putting objects onto the path at the upstream end;

unloading means for taking the objects off the path at the downstream end;

means for moving the objects single-file along the path upstream and downstream of the one station; and a respective printer in each of the lanes;

control means for assigning the different images to the different objects, monitoring position along the production path of each of the objects, splitting the objects up and feeding the objects to the lanes from the path, determining when an object is in a given printer, and then operating the printers to print the different images on the objects in the lanes, and returning all the objects to the path after printing.

* * * * *